US005222467A

United States Patent [19]

Sasada

[11] Patent Number: 5,222,467

[45] Date of Patent: Jun. 29, 1993

[54] ENGINE BLOCK

[75] Inventor: Takashi Sasada, Higashihiroshima, Japan

[73] Assignee: Mazda Motor Corporation, Hiroshima, Japan

[21] Appl. No.: 935,774

[22] Filed: Aug. 28, 1992

[30] Foreign Application Priority Data

Aug. 29, 1991 [JP] Japan ..... 3-068974[U]

[51] Int. Cl.[5] ..... F02F 7/00

[52] U.S. Cl. ..... 123/195 H; 123/195 R

[58] Field of Search ..... 123/195 H, 195 R, 195 C

[56] References Cited

U.S. PATENT DOCUMENTS 5,014,659 5/1991 Ohshima et al. ..... 123/195 H 5,024,189 6/1991 Ushio et al. ..... 123/195 H

*Primary Examiner*—Noah P. Kamen

*Attorney, Agent, or Firm*—Keck, Mahin & Cate

[57] ABSTRACT

A cylinder block including an upper block, a crankshaft and a lower block, has a plurality of bearing caps secured to the upper block so as to support the crankshaft for rotation. A generally rectangularly-shaped lower block casing is provided with a first reinforcing rib, located below each bearing cap and extending upright so as to connect opposite side walls of the casing, and a second reinforcing rib, extending from a fitting bracket. A transmission casing is fitted to the cylinder block through the fitting bracket. The second reinforcing rib terminates approximately below one of the bearing caps. The first reinforcing rib associated with the one of the bearing caps is separated from the bearing caps. The first reinforcing ribs are provided with structural stiffnesses such that a first reinforcing rib which is farther away from the one of the bearing caps than another first reinforcing rib has a lower structural stiffness than the other first reinforcing rib.

5 Claims, 13 Drawing Sheets

ENGINE BLOCK

BACKGROUND OF THE INVENTION

1. Field of the Invention

The present invention relates to an engine cylinder block and, more particularly, to the structure of a lower block section of a cylinder block of an automotive vehicle engine.

2. Description of Related Art

Typically, bearings are installed in engine cylinder blocks to support an engine crankshaft for rotation. If a bearing cap, holding an engine crankshaft for rotation in the engine cylinder block, slants, i.e., inclines with respect to the engine cylinder block during engine operation, the engine crankshaft will rub against the bearing cap and produce vibration. In order to avoid vibration of the engine crankshaft due to slanting of the bearing cap, various bearing cap structures have been proposed by which the structural rigidities of bearing caps are increased.

Each bearing cap in some engine cylinder blocks is bolted by side bolts to a skirt portion of the engine cylinder block. Such a bearing cap fixing structure is described in, for instance, Japanese Unexamined Patent Publication No. 59-88,241. It is also known to fix a bearing cap to both side walls and a bottom wall of a lower block of the engine cylinder block by bolts. Such a bearing cap fixing structure is known from, for instance, Japanese Unexamined Patent Publication No. 1-280,667.

Conventional bearing cap fixing structures have been designed without considering differences in vibration among the bearing caps. Consequently, although a conventional bearing cap fixing structure can improve the static supporting stiffness of a bearing cap, the conventional fixing structure is not always effective to suppress vibrations of the bearing cap while the engine vibrates. When the engine itself and a transmission structurally connected to the engine produce vibrations, the upper cylinder block, the lower cylinder block and the transmission are affected by the vibrations differently, and the upper and lower cylinder blocks partially deform in different ways. For instance, the upper and lower cylinder blocks may deform in different directions. If a bearing cap is fastened to both the upper and lower cylinder blocks in a location at which the upper and lower cylinder blocks deform differently, the bearing cap may possibly slant, cause the crankshaft to bend, and produce vibrations due to such bending.

SUMMARY OF THE INVENTION

It is an object of the present invention to provide an improved lower block section structure of an engine cylinder block.

This object is achieved by providing an engine cylinder block including an upper cylinder block section, a crankshaft installed in a lengthwise direction in the engine cylinder block, and a lower cylinder block section. The lower cylinder block section has a plurality of bearing caps arranged in the lengthwise direction, and is secured to the upper cylinder section so as to support the crankshaft for rotation by the bearing caps. The lower cylinder block section, which has a generally rectangularly-shaped casing formed by a bottom wall and a side wall extending upright from the bottom wall, is provided with a first reinforcing rib located below each of the bearing caps and extending upright from the bottom wall so as to connect one side of the side wall to the other side in a direction perpendicular to the lengthwise direction. The lower cylinder block section is further provided with a second reinforcing rib extending from a fitting bracket. The fitting bracket extends downward from one end of the bottom wall, and a transmission casing is fitted to the engine cylinder block, through the fitting bracket, so as to terminate just below a particular one of the bearing caps. The first reinforcing ribs, except for one associated with the particular one of the bearing caps, mount respective bearing caps thereon. The first reinforcing rib, which is associated with the one of the bearing caps, is separated a predetermined distance apart from the one of the bearing caps. The first reinforcing ribs are structured so as to have stiffnesses which becomes lower as a distance from the one of the bearing caps increases.

The first reinforcing rib associated with the one of the bearing caps may be structured so as to mount the one of the bearing caps. In this case, the first reinforcing rib associated with the one of the bearing caps is structured to have a structural stiffness lower than any other first reinforcing rib.

BRIEF DESCRIPTION OF THE DRAWINGS

The above and other objects of the present invention will be apparent to those skilled in the art from the following description when considered in conjunction with the drawings, in which the same reference numbers have been used to denote the same or similar elements throughout, and in which.

DETAILED DESCRIPTION OF THE PREFERRED EMBODIMENTS

Figure 1:
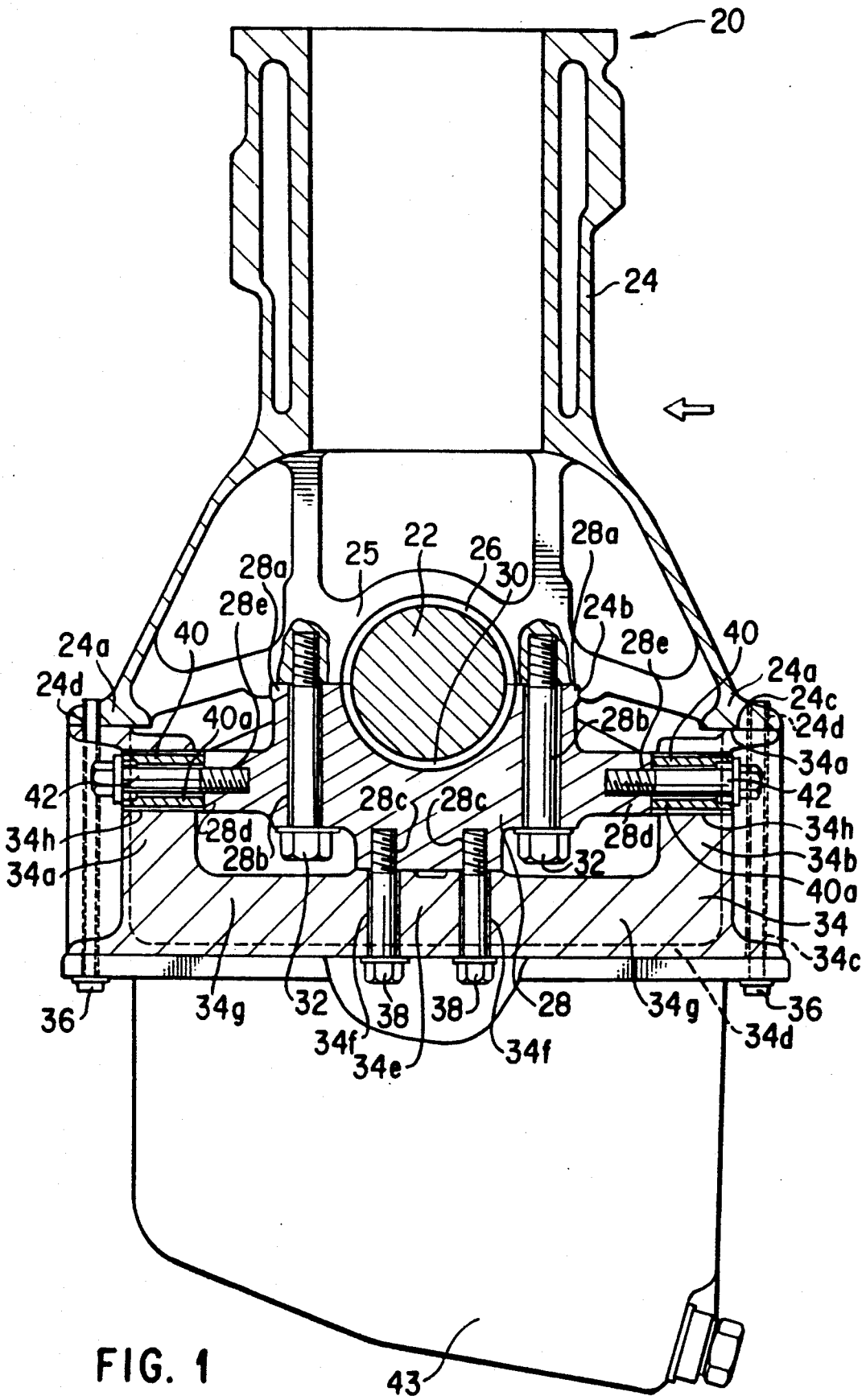
FIG. 1 is a cross-sectional view of an engine cylinder block in accordance with a preferred embodiment of the present invention.

Referring to the drawings in detail and, in particular, to FIG. 1, an engine cylinder block 20 for, for instance, an in-line, four cylinder internal combustion engine, having a lower block structure in accordance with a preferred embodiment of the present invention, is shown. The engine cylinder block 20 includes an upper cylinder block section 24 and a lower cylinder block section 34. The upper cylinder block section 24 is formed with first, second, third and fourth cylinder bores 46 (only one of which appears in the figure). The cylinder bores 46 are arranged in a straight line along which a crankshaft 22 extends. The engine cylinder block 20 is of what is known as a "short skirt" type, and is formed with a skirt portion 24*a* which extends to a level slightly below the axis of rotation of a crankshaft 22. In this embodiment, it is assumed that the crankshaft 22, as shown in FIG. 1, rotates in a counterclockwise direction. The skirt portion 24*a* forms a lower portion of the upper cylinder block section 24 so as to surround the underside of the upper cylinder block section 24. The crankshaft 22 is supported for rotation, between the upper cylinder block section 24 and the lower cylinder block section 34, by forming the upper cylinder block section 24 integrally with a plurality of bearing blocks 25. Each of the bearing blocks 25 is provided with an upper bearing metal 26. The lower cylinder block section 34 is provided with a bearing cap 28. Each of the bearing caps is provided with a lower bearing metal 30. The bearing block 25 and the bearing cap 28 are provided between adjacent cylinder bores 46 and on each side of the straight line arrangement of the cylinder bores 46. The engine cylinder block 20 is provided with a total of five sets of the bearing block 25 and the bearing cap 28. In order to position the lower bearing cap 28, in a transverse direction, perpendicular to the rotational axis of the crankshaft 22, the upper cylinder block section 24 is formed with a recess 24*b* in its underface. When assembling the engine cylinder block 20, upper sides 28*a* of the lower bearing cap 28 are fitted in the recess 24*b*. Consequently, the bearing metals 26 and 30 meet and are precisely positioned in the transverse direction. For bolting the lower bearing cap 28 to the underside of the upper cylinder block section 24, the lower cylinder block section 34 is formed with bores 28*b* through which fastening bolts 32 are inserted.

The lower cylinder block section 34 is fastened by bolts 36 to the upper cylinder block section 24. The upper fitting surface 34*c* of the lower cylinder block section is fitted to a lower fitting surface 24*c* of the skirt portion 24*a*. The lower cylinder block section 34 is formed as a generally rectangular box having an open upper side. Side walls 34*a* and 34*b* of the lower cylinder block section 34, extending in a lengthwise or axial direction in which the crankshaft 22 extends, are formed with a plurality of bores 34*c*. The skirt portion 24*a* is formed with female threads 24*d* which correspond to the bores 34*c* of the side walls 34*a* and 34*b* of the lower cylinder block section 34. Bolts 36 are inserted through the bores 34*c* and engage with the threads 24*d* so as to rigidly fasten the lower cylinder block section 34 to the upper cylinder block section 24.

In addition to bolting the bearing cap 28 to the upper cylinder block section 24, the lower cylinder block section 34 supports the bearing cap 28. Specifically, the lower cylinder block section 34 is formed integrally with a bearing mount bed 34*e* extending upright from the bottom wall 34*d*. The bearing mount bed 34*e* is formed at the middle of the lower cylinder block section 34 between the side walls 34*a* and 34*b*. The lower cylinder block section 34 is further formed integrally with a reinforcing rib 34*g*, which extends between and is rigidly connected to the bearing mount bed 34*e* and each of the side walls 34*a* and 34*b* so as to structurally reinforce the bearing mount bed 34*e*. The bearing mount bed 34*e* is formed with a pair of bores 34*f* located at equal separations from a vertical line passing through the rotational axis of the crankshaft 22. The bearing cap 28 is formed with female threads 28*c* corresponding to the bores 34*f* of the bearing mount bed 34*e* of the lower cylinder block section 34. When assembling the engine cylinder block 20, after fitting the bearing mount bed 34*e* to the underside of the bearing cap 28, a pair of bolts 38 is inserted through the bores 34*f* and engages with the threads 28*c* so as to rigidly fasten the bearing cap 28 to the lower cylinder block section 34. The side walls 34*a* and 34*b* are formed with threaded bores 34*h* extending in the transverse direction. Each of the threaded bores 34*h* is engaged with a threaded hollow bush 40. The bearing cap 28 has front and rear bosses 28*d*, each of which is further formed with female threads 28*e*. The female threads 28*e* correspond to each of the bores 34*h* of the side walls 34*a* and 34*b* of the lower cylinder block section 34. When assembling the engine cylinder block 20, a bolt 42 is inserted through a bore 40*a* of the hollow bush 40 and engages with the threads 28*e* so as to rigidly fasten the bearing cap 28 to the lower cylinder block section 34. The bush 40 is made of a metal which has a low Young's modulus and, consequently, is rather elastic. Such allows the fastening power of the bolts between the side walls 34*a* and 34*b* of the lower cylinder block section 34 and the bearing cap 28 to be adjustable. The bottom of the engine cylinder block 20 is attached to an oil pan 43 which contains oil for lubrication of movable engine elements.

When the engine cylinder block 20 has been assembled, the bearing cap 28 is firmly and rigidly supported by the front, rear and bottom walls of the lower cylinder block section 34. The bearing cap 28, rigidly supported in this way, is prevented from slanting or deforming. The bearing cap, therefore, does not rub against the engine crankshaft 22. As will be described in detail later, the five bearing caps 28 are fastened to the bearing blocks 25 differently from one another.

Figure 2:
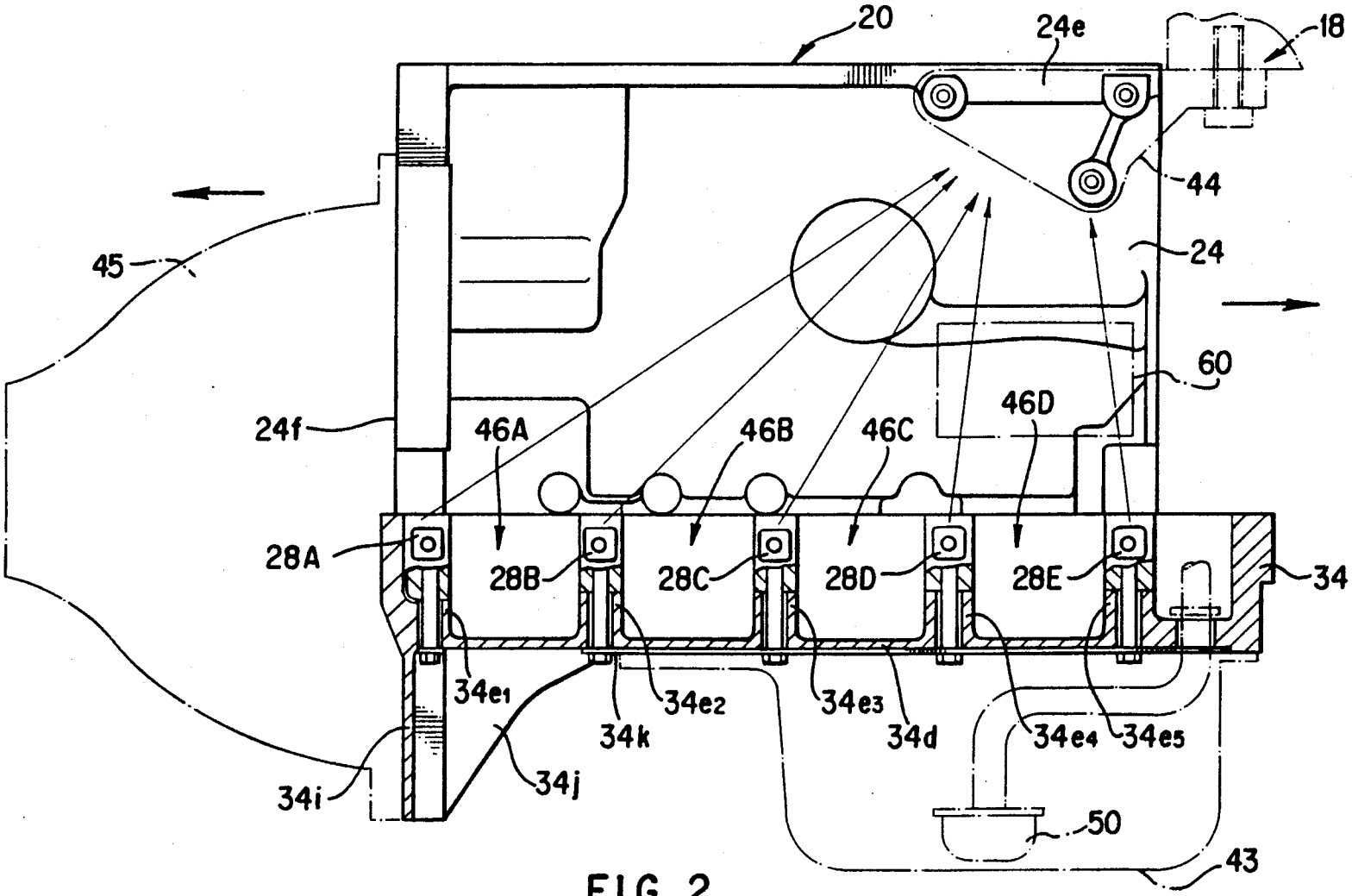
FIG. 2 is a side view, partly in cross section, of the engine cylinder block of FIG. 1.

In FIG. 2, the bearing caps 28 are designated from the rear by reference numerals 28A to 28E for distinction, and the cylinder bores 46 are designated from the rear by reference numerals 28A to 28E for distinction. The in-line, four cylinder internal combustion engine is mounted in an engine compartment (not shown) of a vehicle body 18 so as to orient the crankshaft 22 in a transverse direction of the vehicle body 18. For mounting the engine, the upper cylinder block section 24 is formed at its upper end with a reinforcing rib 24*e*, by which the engine block 20 is firmly secured to a mount bracket 44 bolted to the vehicle body 18. The engine cylinder block 20 is firmly attached to transmission casing 45 rigidly supported in the engine compartment by an engine mount (not shown) of the vehicle body 1. As was previously described, each bearing cap 28 is bolted to both the side walls 34*a* and 34*b* by side fastening bolts 42.

The lower cylinder block section 34 is integrally formed, at the rear end, with a flat fitting bracket 34*i* extending downward, to which the transmission casing 45 is secured. Similarly, the upper cylinder block section 24 is formed with, at the rear end, a fitting surface 24*f* to which the transmission casing 45 is secured. The transmission casing 45, thus secured to the engine cylinder block 20, tends to produce vibrations separately from the engine cylinder block, which are different in mode from vibrations that the engine cylinder block itself produces. Such separate and different vibrations are quite uncomfortable for passengers in the vehicle. In order to make the transmission casing 45 produce vibrations of the same mode as those produced by the engine cylinder block 20, the lower cylinder block section 34 is integrally formed, on each of its sides, with a pair of generally triangularly-shaped reinforcing ribs 34*j* arranged in parallel in the axial direction. Each of the reinforcing ribs 34*j* extends forward between the fitting bracket 34*i* and the bottom wall 34*d* of the lower cylinder block section 34, as is clearly shown in FIG. 7. A point 34*k* at which the reinforcing rib 34*j* terminates is located right below a location at which the bearing cap 28B is disposed between the first cylinder bore 46A and the second cylinder bore 46B. In this way, the transmission casing 45 is firmly secured to the entire engine cylinder block 20.

Figure 3:
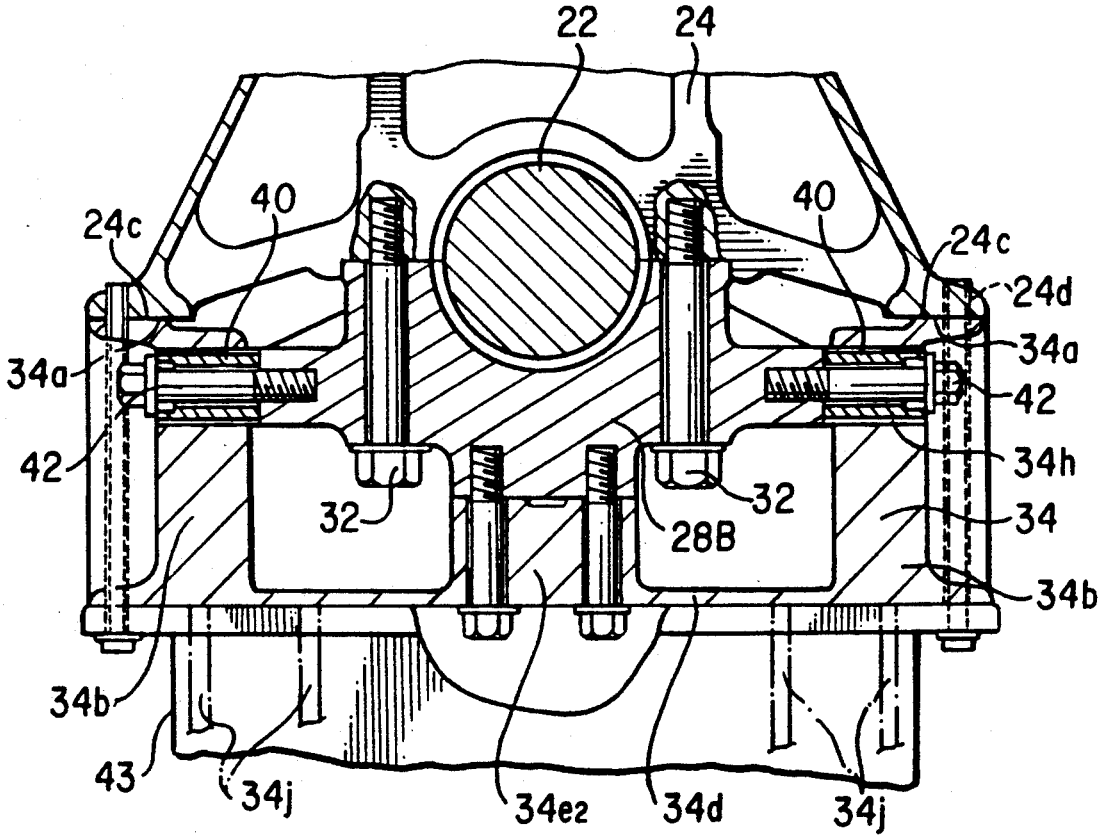
FIG. 3 is a cross-sectional view showing a bearing cap disposed between a first cylinder and a second cylinder.
Figure 4:
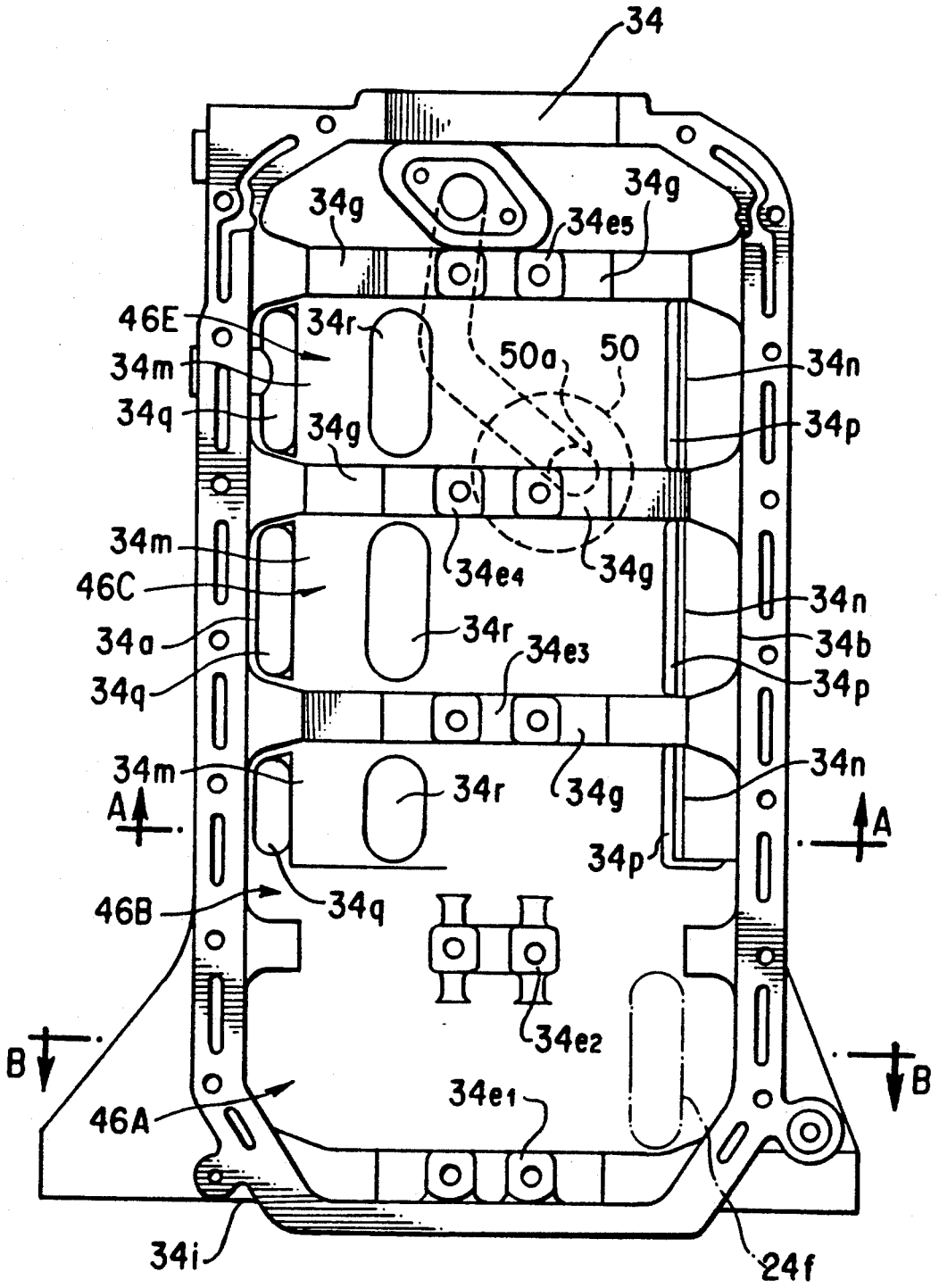
FIG. 4 is a plan view of a lower cylinder block section of the engine cylinder block of FIG. 1.
Figure 5:
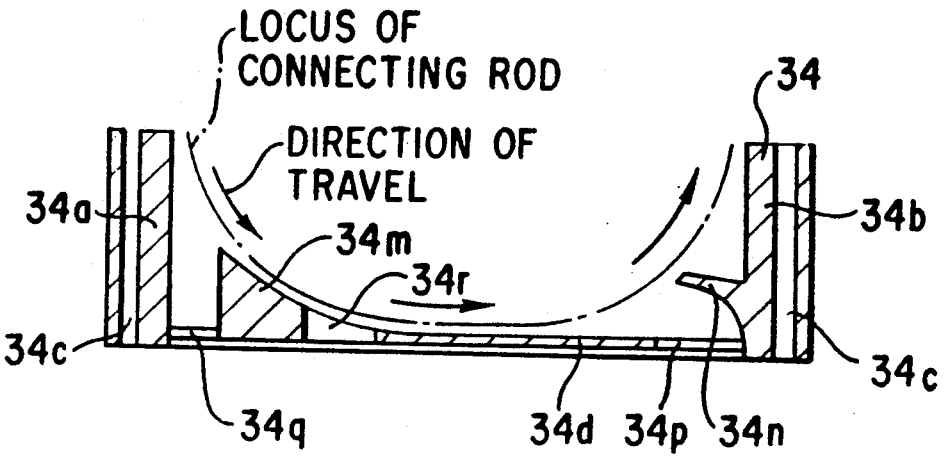
FIG. 5 is a cross-sectional view of FIG. 4 along A—A.

As was previously described, the first to fifth cylinder bores 46A to 46E are arranged, in order, from the rear end of the engine cylinder block 20. On opposite sides of each of the first to fifth cylinder bores 46A to 46E, as viewed in the lengthwise direction, the bearing caps 28A to 28E are installed. The bearing caps 28A to 28E are secured to the lower cylinder block section 34 in different manners. In more detail, as shown in FIGS. 2 and 3, all of the bearing caps, except for the bearing cap 28B below which the reinforcing rib 34*j* terminates at the terminal point 34*k*, are secured to the lower cylinder block section 34 in the way described in connection with and shown in FIG. 1. These bearing caps, therefore, are prevented from slanting in the axial direction. FIG. 3 shows the bearing cap 28B, disposed between the first and second cylinder bores 46A and 46B, as being secured to a bearing mounting bed 34$e_2$ projecting from the bottom wall 34*d*. However, no reinforcing rib for rigidly connecting the bearing mount bed 34$e_2$ to the bearing mount bed 34*e* and each of the side walls 34*a* and 34*b* is formed. This is because if the entire block of the engine cylinder block 20 and the transmission casing 46, which has a large mass, produces vibration as one unit, a reaction force is transmitted to the reinforcing rib 34*j* through the fitting bracket 34*i*. This reaction force concentrated on the lower wall 34*d* at the terminal point 34*k*. Consequently, reaction to the force which causes the transmission casing 45 to produce vibration acts on the lower cylinder block section 34 so as to generate vertical vibrations of part of the lower cylinder block section 34 around the terminal point 34*k*. Such vertical vibrations result in deformation or bending of the part in a plane perpendicular to the axis of the crankshaft 22. If reinforcing ribs are formed between the bearing mount bed 34$e_2$ and each of the side walls 34*a* and 34*b*, during such vertical vibrations, the bearing mount bed 34$e_2$, located right above the terminal point 34*k*, will be directly subjected to a "thrust-up" force by the reinforcing rib 34*j* through the reinforcing ribs. This causes a slant of the bearing mount bed 34*g* in the axial direction, which generates a force that acts on the bearing cap 28B to make it slant the same direction. As a result, the bearing cap 28B applies a force to the crankshaft 22 so as to rub against and bend it. This generates vibration of the crankshaft 22. By not providing any reinforcing rib between the bearing mount bed 34$e_2$ for the second bearing cap 28B, the transmission of thrust-up force from the reinforcing rib 34*j* is disconnected.

Figure 6:
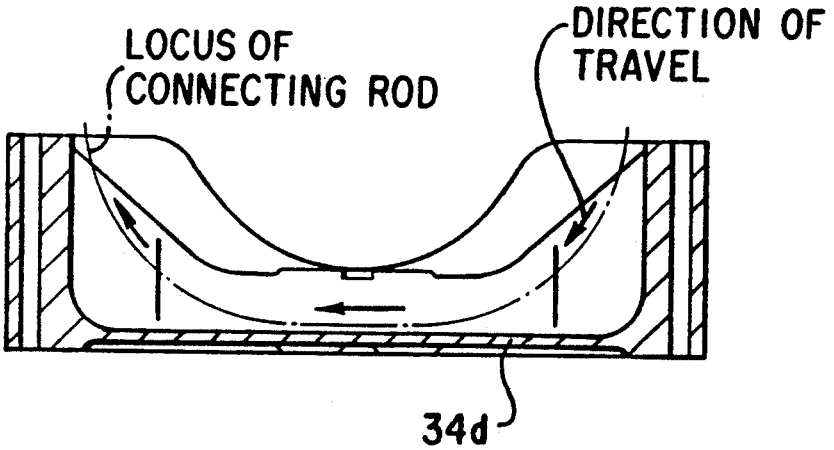
FIG. 6 is a cross-sectional view of FIG. 4 along line B—B.
Figure 7:
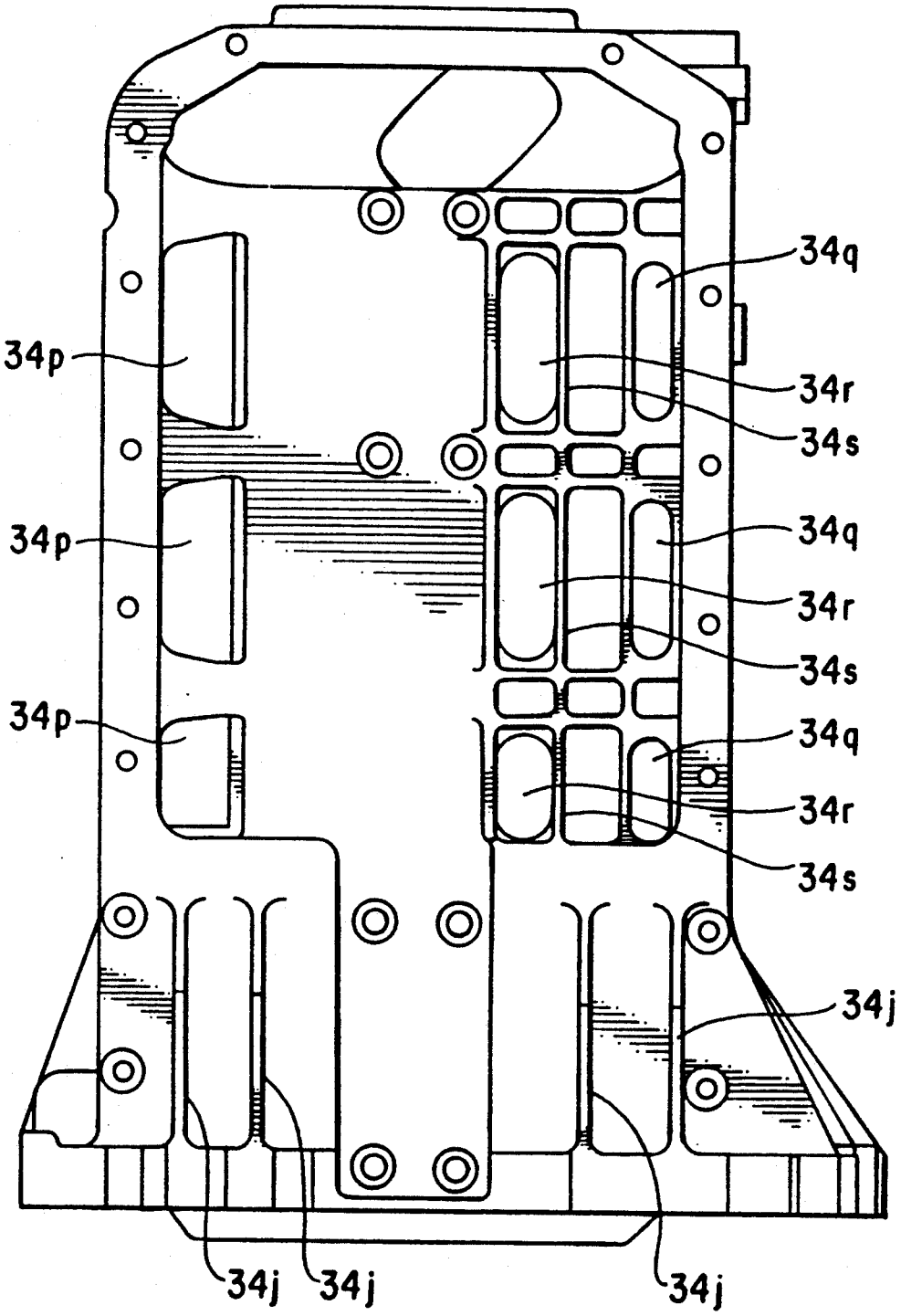
FIG. 7 is a bottom view of the lower cylinder block section of the engine cylinder block of FIG. 1.

FIGS. 4 to 7 show structural details of the lower cylinder block section 34. As is most clearly seen in FIG. 4, reinforcing ribs 34*g* connect the bearing mount bed 34*e* to opposite side walls 34*a* and 34*b* for each of the bearing caps 28A and 28C to 28E. Such is not the case for the bearing cap 28B between the first and second cylinder bores 46A and 46B. On opposite sides of the bearing mount bed 34$e_2$, to which the bearing cap 28B is secured, no reinforcing rib is provided. Right below respective cylinder bores, except for the first cylinder bore 46A, the lower cylinder block section 34 is formed with a bottom wall portion 34*d* having a curved upper face 34*m* extending in the transverse direction. The curved upper face 34*m* has a locus along which a connecting rod (not shown) of the crankshaft 22 travels. The curved upper face 34*m* is precisely shaped along the locus of the connecting rod near the entrance side of the lower cylinder block section 34. The entrance side of the lower cylinder block section is on the top of the drawing, and the connecting rod enters into the lower cylinder block section 34 from this entrance side. The curved upper face gradually becomes flatter toward the exit side, through which the connecting rod exits from the lower cylinder block section 34. The lower cylinder block section 34 is provided with a baffle 34*n*, extending from the side wall 34*b* on the exit side toward the side wall 34*a* on the entrance side. The baffle 34*n* allows less oil to be splashed by the connecting rod. The lower cylinder block section 34 has an oil return hole 34*p*, formed in the bottom wall 34*d* directly below the buffer 34*n*, for allowing oil trapped by the baffle 34*n* to return into the oil pan 43. An oil return hole 34*q* is also formed in the bottom wall 34*d* between the side wall 34*a* and the end of the curved upper face 34*m* on the entrance of the lower cylinder block section side. Further, an oil return bore 34*r* is formed in the bottom wall 34*d* close to the entrance side. The oil return bore 34*r* is provided to efficiently return oil staying over the curved upper face 34*m* of the bottom wall 34*d*. As is well known in the art, in the oil pan 43, an oil strainer 50 is disposed for picking up oil in the oil pan 43 and recirculating the oil through the engine cylinder block 20. The oil strainer 50 has an inlet 50*a*, located on a side wall of the oil pan 43 close to the exit side of the lower cylinder block section 34; this inlet is shown by chained line in FIG. 4. It is desired to locate the oil return bore 34*r* as far from the inlet 50*a* of the oil strainer 50 as possible. This is because air, produced in oil in the oil pan 43 by oil dropping through the oil return bore 34*r*, is not drawn into the oil strainer 50. If oil drawn into the oil strainer 50 contains air, it is not cooled sufficiently. This may lead to seizing of the engine. The lower cylinder block section 34 suffers from a decrease in structural stiffness due to the oil return holes and bores which are formed in locations at which the lower cylinder block section 34 is subjected to considerable internal forces caused by combustion in the engine cylinders. In order to prevent part of the bottom wall 34*d* of the lower cylinder block section 34 around the oil return hole and bores 34*p*, 34*q* and 34*r* from being cracked or broken due to combustion, the lower cylinder block section 34 has ribs 34*s* formed outside of the bottom wall 34*d*, as shown in FIG. 7.

FIG. 6 shows the lower cylinder block section 34 as having a flat part of the bottom wall 34*d* surrounding the bearing mount bed $34e_2$. The flat part of the bottom wall is located right below the first cylinder bore 46A in order to lower the structural rigidity of the bearing mount bed $34e_2$ for the bearing cap 28B. As was previously described in conjunction with FIG. 5, the remaining part of the bottom wall 34*d* below the cylinder bores 46B to 46E, which has a curved upper face 34*m*, allows the connecting rods to pick up oil easily. It is desirable for engine lubrication to have oil be easily picked up and carried by the connecting rods. However, the oil picked up by the connecting rods tends to enter into a passage opening into lower portion of the upper cylinder block section 24 for blow-by gas circulation. It is, of course, possible to remove oil from blow-by gas by an oil separator disposed in the circulation passage and feed it into an intake system for re-burning. However, it is undesirable for blow-by gas to contain a lot of oil, even assuming the blow-by gas is filtered by an oil separator. In order to have less oil enter into blow-by gas, the engine cylinder block 20 is provided with a blow-by gas circulation passage (not shown) having an opening 24*f* (shown by double dotted chained line in FIG. 4). The opening 24*f* is formed in the upper cylinder block section 24 right above the flat portion of the bottom wall 34*d* of the lower cylinder block section 34 which is flattened to provide a weakness or low structural stiffness.

Each of the bearing caps 28A to 28E is secured to the lower cylinder block section 34 from the side with a fastening force which is adjustable. This is one of the significant features of the engine cylinder block structure of this invention.

Engine vibrations are classified into two primary types. One type of vibrations includes vibrations caused in the entire engine, as a rigid body, by a reaction force produced when pistons are forced down during expansion strokes. The other type of vibrations includes vibrations caused in the crankshaft 22 and the crankshaft fly wheels due to combustion. Vibrations of the latter type are initially transmitted to the upper cylinder block section 24 through the bearing caps 28A to 28E and then to the vehicle compartment through the mounting bracket 44. Since the passenger compartment is closer to the mounting bracket 44 than to the rear engine mount for mounting the transmission casing 45, passengers suffer more from the vibrations transmitted through the mounting bracket 44 than those transmitted through the rear engine mount.

The mount bracket 44 of the engine cylinder block 20 is at different distances from the respective bearing caps 28A to 28E. Consequently, the periods or times required for vibrations of the respective bearing caps 28A to 28E to be transmitted to the engine mount bracket 44 are different. By contrast, intervals between combustion explosions of the respective cylinders 46A to 46E are constant. As a result, if vibrations are transmitted to the engine mount bracket 44 from the respective bearing caps 28A to 28E at the same speed, vibrations caused in adjacent cylinders, which are subjected to combustion explosions at different times, do not overlap and are transmitted separately to the passenger compartment through the engine mount bracket 44. This minimizes passenger discomfort due to a reinforcement of vibrations resulting from an interference of these vibrations. For example, combustion explosions in the respective cylinders 46A to 46E may occur at intervals during engine operation at a high speed which are shorter than the times at which vibrations caused in the respective bearing caps 28A to 28E are transmitted to the engine mount bracket 44. As a result, vibrations among the respective cylinders 46A to 46E overlap, and vibration transmitted to the passengers is periodic, as long as the vibrations are transmitted from the respective bearing caps 28A to 28E at the same time. This eliminates uncomfortable feelings. Taking this into consideration, the engine cylinder block 20 is provided with bearing caps 28A to 28E which are secured to the lower cylinder block section 34 with different fastening forces so as to transmit vibrations caused in the respective bearing caps 28A to 28E at the same time. Specifically, the further a bearing cap is located from the engine mount bracket 44, the lower the fastening force is by which the bearing cap is bolted from the sides. That is, the bearing cap 28E, which is the bearing cap located closest to the engine mount bracket 44, is bolted sideways with the strongest fastening force, and the bearing cap 28A, which is the bearing cap located at the longest distance from the engine mount bracket 44, is bolted sideways with the weakest fastening force.

Vibrations that make passengers feel uncomfortable are typically generated at low frequencies, i.e., frequencies in a range of 200 to 500 Hz, by periodic bending of the engine crankshaft due to run-out of crank pulleys and fly-wheels. Such vibrations produce what is called a "rumbling" sound. Such a rumbling sound is usually generated while the engine operates at speeds of approximately 3,500 to 4,000 r.p.m. To reduce rumbling sounds, the bearing caps 28A to 28E are bolted sideways with different fastening torques; such torques range between approximately 80 and approximately 270 Kg-cm. The bearing caps 28A to 28E are bolted sideways with torques which gradually increase from 80 to 270 Kg-cm, respectively, so that the bearing cap 28A, which is at the largest distance from the engine mount bracket 44, is bolted sideways with the smallest fastening torque. The smallest fastening torque is approximately 80 Kg-cm. The bearing cap 28E, which is the cap closest to the engine mount bracket 44, is bolted sideways with the largest fastening torque, namely, approximately 270 Kg-cm. If there is an engine operated supplemental device 60 attached to the engine between the engine mount bracket 44 and the bearing caps 28A to 28E, the bearing cap 28 closest to the supplemental device 60 is bolted sideways with the smallest fastening torque. This is because the mass of the supplemental device 60 resists vibration. The natural frequency of part of the engine cylinder block around a bearing cap which is fastened sideways with a weakened fastening torque is increased. This allows vibrations to be transmitted at an increased speed from the bearing cap to the engine mount bracket 44 and reach the engine mount bracket 44 in a shorter time. Conversely, part of the engine cylinder block around a bearing cap which is fastened sideways with an increased fastening torque is increased in mass by the lower cylinder block section 34. Consequently, the natural frequency of this part is increased, and vibrations are transmitted at a decreased speed from the bearing cap to the engine mount bracket 44. These vibrations, therefore, reach the engine mount bracket 44 in a longer time. Consequently, vibrations are transmitted to the engine mount bracket 44 from all of the bearing caps 28A to 28E at almost the same time. This results in preventing interference of vibrations caused by combustion in the respective cylinders and keeps vibrations which are uncomfortable to passengers at a low level.

For fastening the bearing caps 28A to 28E differently and sideways in an engine block assembling line, data representative of fastening torques necessary to properly bolt each of the bearing caps 28A to 28E is experimentally collected for one or several engine cylinder blocks per model so as to determine an average fastening torque.

Figure 8:
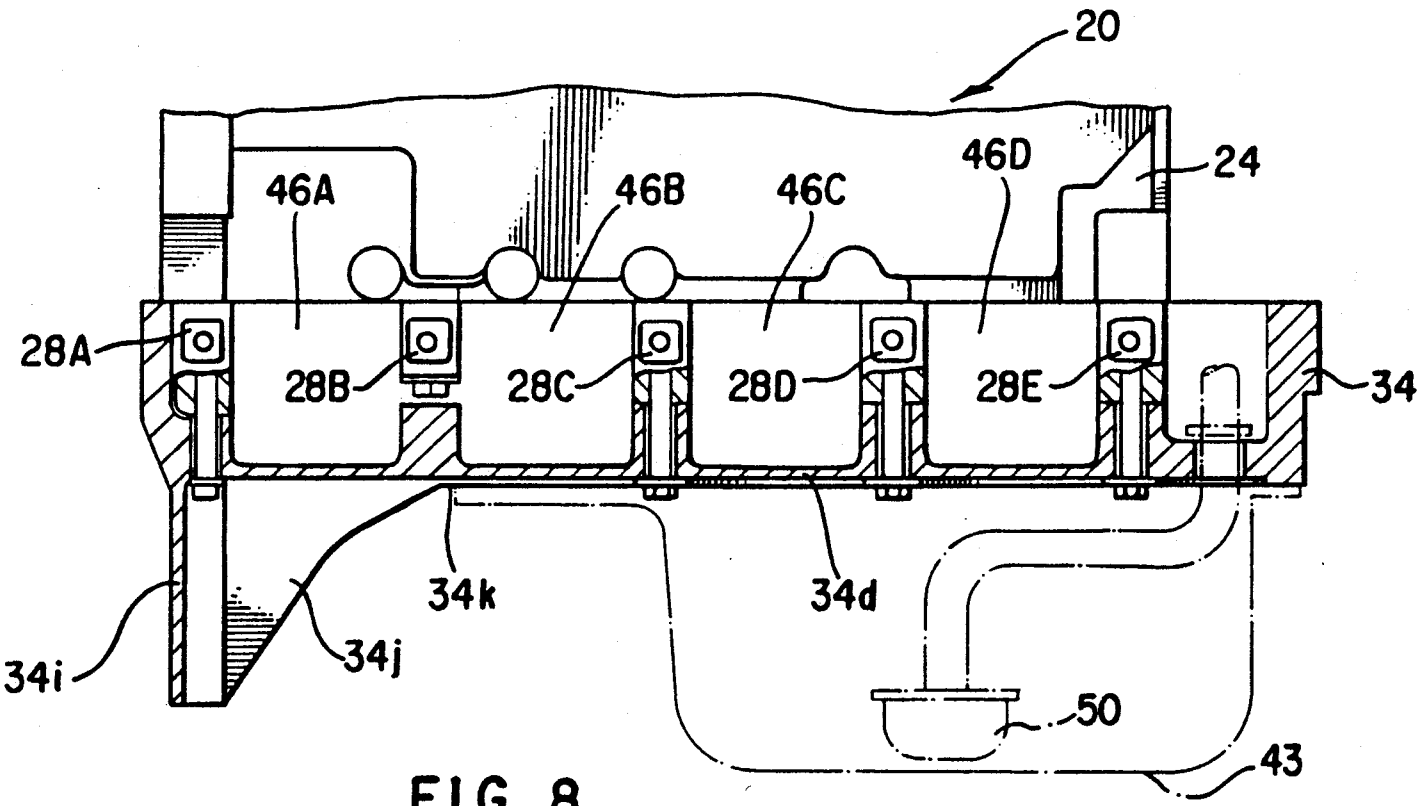
FIG. 8 is a side view, partly in cross section, of an engine cylinder block in accordance with another preferred embodiment of the present invention.
Figure 9:
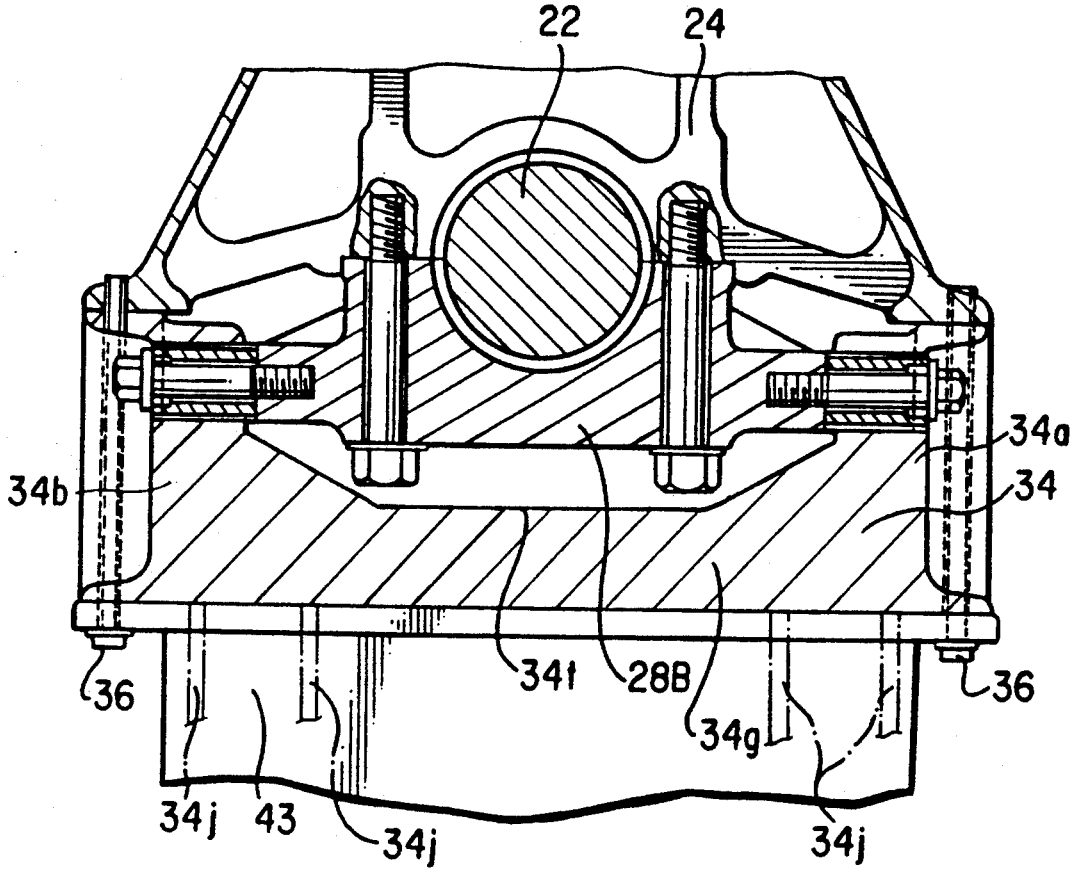
FIG. 9 is a cross-sectional view showing a bearing cap disposed between a first cylinder and a second cylinder of the engine cylinder block of FIG. 8.

FIGS. 8 and 9 show a modified engine cylinder block 20. In the cylinder block illustrated in those figures, there is provided, below the bearing cap 28B disposed between the first and second cylinder bores 46A and 46B, a reinforcing rib 34*g* extending between the side walls 34*a* and 34*b*. However, the bearing cap 28B is not mounted on the rib 34*g*. The reinforcing rib 34*g* is formed, at its middle portion, with an undercut 34*t*, which provides a space between the bearing cap 28B and the reinforcing rib 34*g*. In this modified engine cylinder block 20, the bearing mount bed $34e_2$, located right above the terminal point 34*k*, is prevented from being subjected to a thrust-up force by the fitting bracket 34*i* through the reinforcing rib 34*j*.

Figure 10:
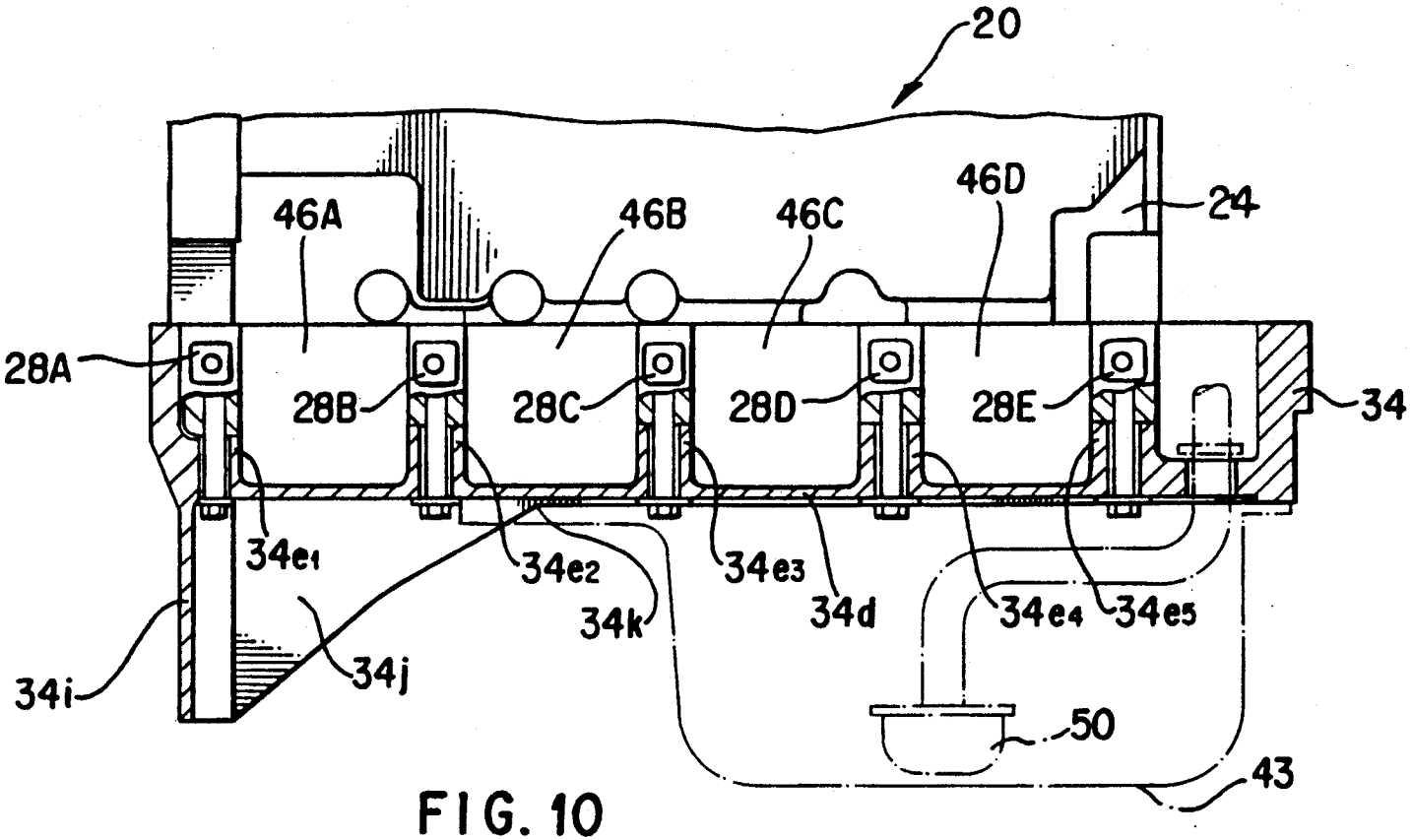
FIG. 10 is a side view, partly in cross section, of an engine cylinder block in accordance with still another preferred embodiment of the present invention.

Instead of providing the reinforcing rib 34*g* with an undercut 34*t* located below the bearing cap 28B disposed between the first and second cylinder bores 46A and 46B, the reinforcing rib 34*j* may be modified as shown in FIG. 10.

FIG. 10 shows the lower cylinder block section 34 as being integrally formed on each of its sides with a pair of generally triangularly-shaped reinforcing ribs 34*j* arranged so as to be parallel in the axial direction. Each of the ribs 34*j* extends forward between the fitting bracket 34*i* and the bottom wall 34*d* of the lower cylinder block section 34. The respective reinforcing rib 34*j* terminates at a terminal point 34*k* located beyond the bearing cap 28B disposed between the first and second cylinder bores 46A and 46B. All of the bearing caps 28, including the bearing cap 28B, are secured to the bearing mount beds 34*e* in the same manner as that shown in FIG. 1. In this modified engine cylinder block 20, the bearing cap 23B, located right above the terminal point 34*k*, is prevented from being subjected to a thrust-up force by the fitting bracket 34*i* through the reinforcing rib 34*j*.

Figure 11:
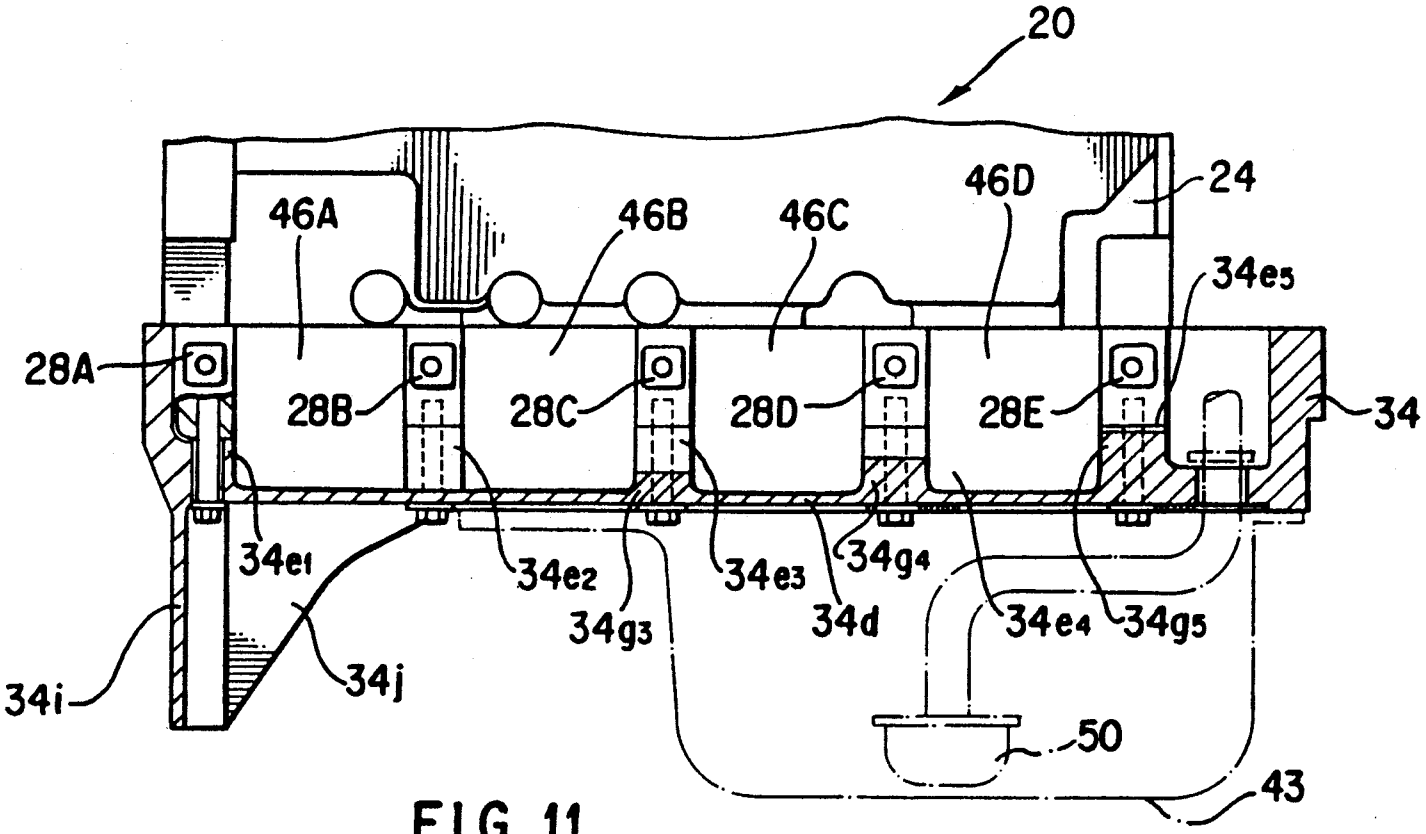
FIG. 11 is a side view, partly in cross section, of an engine cylinder block in accordance with still another preferred embodiment of the present invention.
Figure 12:
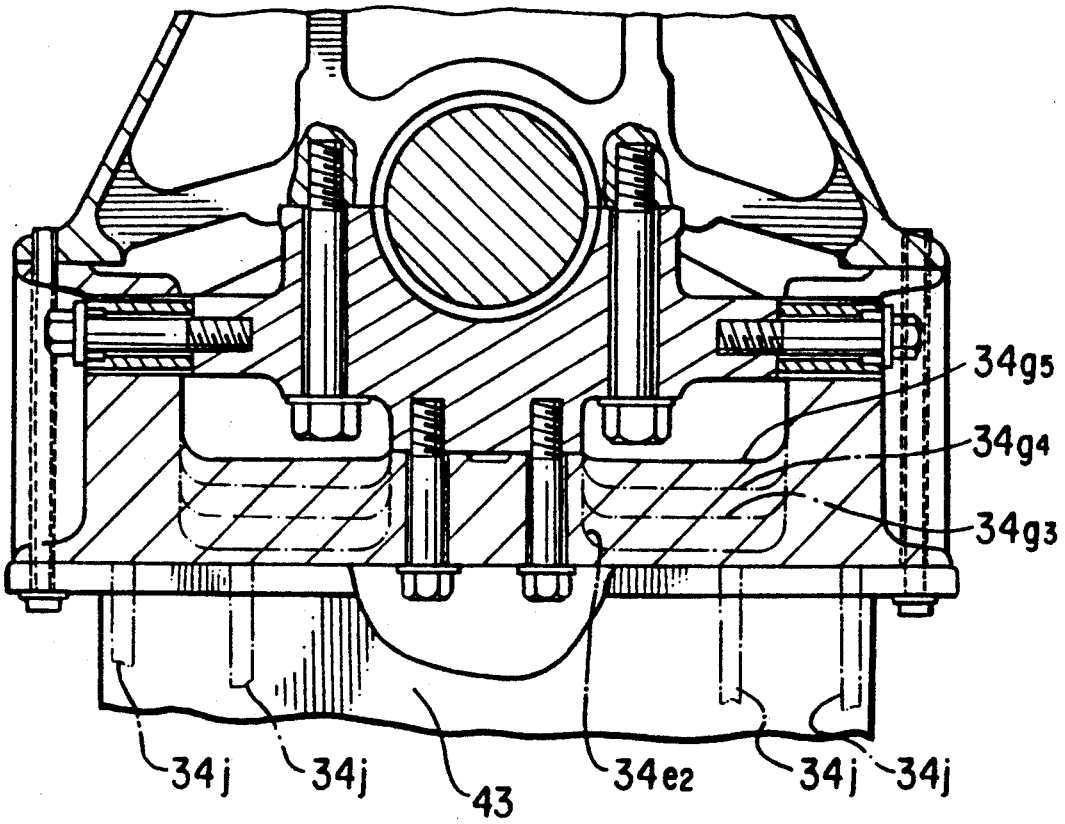
FIG. 12 is a cross-sectional view showing a bearing cap disposed between a first cylinder and a second cylinder of the engine cylinder block of FIG. 11.
Figure 13:
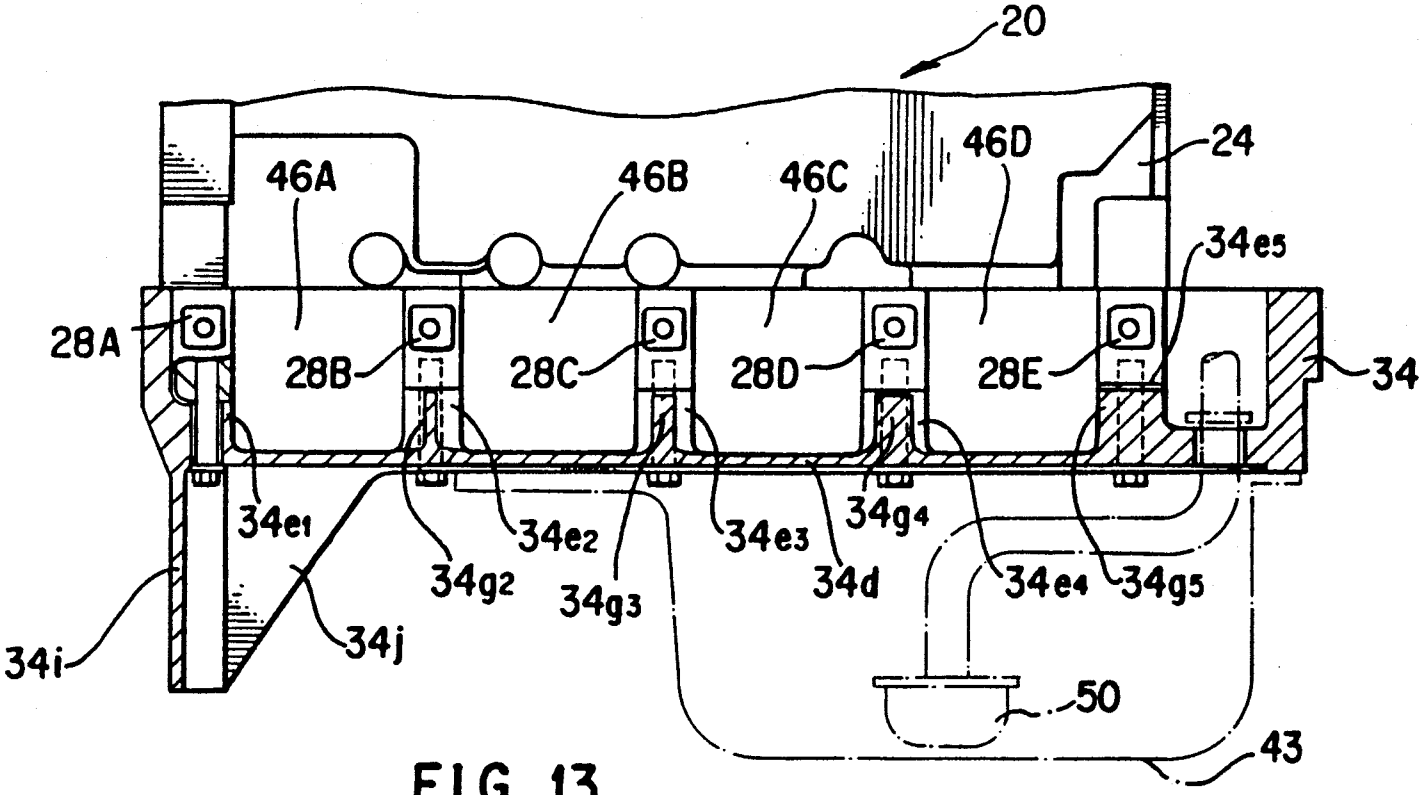
FIG. 13 is a side view, partly in cross section, of an engine cylinder block in accordance with yet another preferred embodiment of the present invention.

FIGS. 11 to 13 show modified embodiments of the engine cylinder block 20. In these modified embodiments, ribs $34g_1$ to $34g_5$ for reinforcing the bearing mount beds $34e_1$ to $34e_5$ for the bearing caps 28A to 28E are provided with different rigidities. The engine cylinder block shown in FIGS. 11 and 12 is provided with ribs $34g_1$ to $34g_5$ having different heights. That is, the further away a rib 34*g* is from the generally triangularly-shaped reinforcing ribs 34*j*, terminating below the bearing cap 28B disposed between the first and second cylinder bores 46A and 46B, the higher it is. Otherwise, the ribs $34g_1$ to $34g_5$ may be provided with different thicknesses. As shown in FIG. 13, the rib 34*g* is thicker the farther away it is located from the generally triangularly-shaped reinforcing ribs 34*j*.

Figure 14:
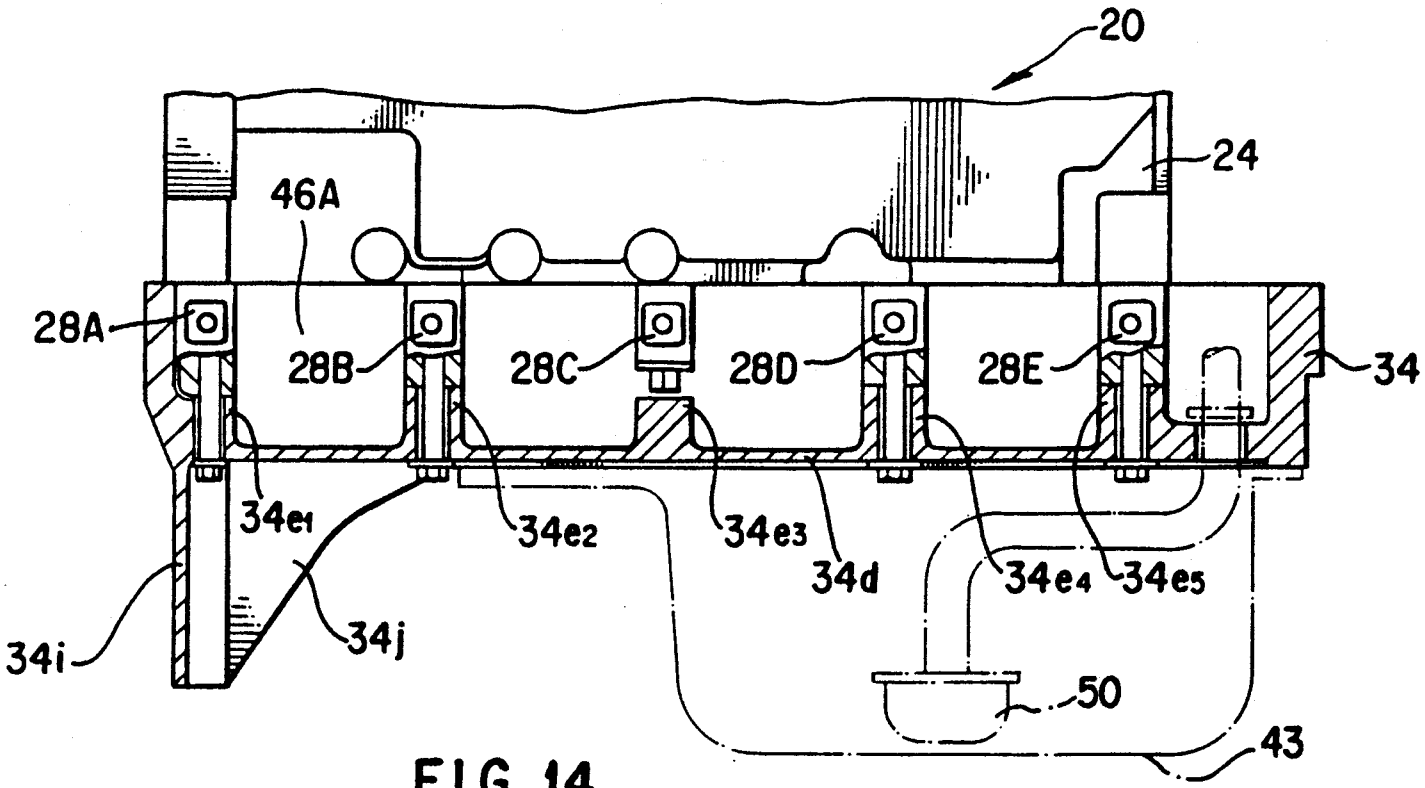
FIG. 14 is a side view, partly in cross section, of an engine cylinder block in accordance with a further preferred embodiment of the present invention.

FIG. 14 shows another modified embodiment of the engine cylinder block 20. In this embodiment, a central bearing cap 28C is located in an approximately middle position in the axial direction or between the second cylinder bore 46B and the third cylinder bore 46C. The central bearing cap 28C is structurally separated from the lower cylinder block section 34. The reason for this is that because vibrations of the entire engine cylinder block 20 have an amplitude crest at the middle point, in the axial direction, of the lower cylinder block section 34, if the central bearing cap 28C, located at the amplitude crest point, is secured to both the upper engine cylinder block section 24 and the lower engine cylinder block section 34, it inclines rather easily due to vibration, so as to rub against the engine crankshaft 22. Structurally separating the central bearing cap 28C from the lower cylinder block section 34 provides an improved vibration suppressing effect. The separated center bearing cap 28B may be installed in the engine cylinder block 20 of any previous embodiment.

An engine cylinder block constructed according to the present invention prevents the bearing cap from suffering from vibrations or vibrating forces transmitted through the reinforcing ribs extending between the transmission fitting bracket to the part of the lower cylinder block section below the bearing cap. This eliminates a slanting of the bearing cap, thereby considerably reducing vibrations of the crankshaft typically caused by a slanted bearing cap.

It is to be understood that although specific embodiments of the present invention have been described, various other embodiments and variants may occur to those skilled in the art. Any such other embodiments and variants which fall within the scope and spirit of the invention are intended to be covered by the following claims.

What is claimed is:

1. An engine cylinder block for an automotive vehicle including an upper cylinder block section, a crankshaft installed in a lengthwise direction in the engine cylinder block, and a lower cylinder block section, having a plurality of bearing caps arranged in the lengthwise direction, which is secured to the upper cylinder block section so as to support the crankshaft for rotation by the bearing caps, said lower cylinder block section comprising:

a generally rectangularly-shaped bottom wall;

a side wall extending upright from said bottom wall so as to surround said bottom wall;

a first reinforcing rib provided below each of said bearing caps and extending upright from said bottom wall so as to connect one side of said side wall to the other side of said side wall in a direction perpendicular to the lengthwise direction;

a fitting bracket extending downward at a right angle with respect to the lengthwise direction from one end of said bottom wall for fitting a transmission casing to said engine cylinder block therethrough; and a second reinforcing rib extending from said fitting bracket to each side portion of said bottom wall so as to terminate approximately below one of said bearing caps;

wherein each first reinforcing rib, except for the said first reinforcing rib associated with said one of said bearing caps, mounts thereon a respective one of said bearing caps, and said first reinforcing rib associated with said one of said bearing caps is separated apart from said one of said bearing caps.

2. An engine cylinder block as defined in claim 1, wherein the first reinforcing ribs are provided with structural stiffnesses such that a first reinforcing rib which is farther away from said one of said bearing caps than another first reinforcing rib has a lower structural stiffness than the other first reinforcing rib.

3. An engine cylinder block for an automotive vehicle including an upper cylinder block section, a crankshaft installed in a lengthwise direction in the engine cylinder block, and a lower cylinder block section, having a plurality of bearing caps arranged in the lengthwise direction, which is secured to the upper cylinder block section so as to support the crankshaft for rotation by the bearing caps, said lower cylinder block section comprising:

a generally rectangularly-shaped bottom wall;

a side wall extending upright from said bottom wall so as to surround said bottom wall;

a first reinforcing rib provided below each of said bearing caps and extending upright from said bottom wall so as to connect one side of said side wall to the other side of said side wall in a direction perpendicular to the lengthwise direction;

a fitting bracket extending downward at a right angle with respect to the lengthwise direction from one end of said bottom wall for fitting a transmission casing to said engine cylinder block therethrough; and a second reinforcing rib extending from said fitting bracket to each side portion of said bottom wall so as to terminate approximately below one of said bearing caps;

wherein each first reinforcing rib mounts thereon a respective one of said bearing caps, and the first reinforcing rib associated with said one of said bearing caps is structured so as to have a stiffness lower than other first reinforcing rib.

4. An engine cylinder block as defined in claim 3, wherein the first reinforcing ribs are provided with structural stiffnesses such that a first reinforcing rib which is farther away from said one of said bearing caps than another first reinforcing rib has a lower structural stiffness than the other first reinforcing rib.

5. An engine cylinder block as defined in claim 3, wherein the first reinforcing rib associated with said one of said bearing caps is bolted to said one of said bearing caps.

* * * * *